United States Patent [19]

Merker et al.

[11] 3,988,016

[45] Oct. 26, 1976

[54] HIGH SPEED IN-LINE PAPER INSERTING APPARATUS AND METHOD

[75] Inventors: George Merker, Fair Lawn, N.J.; Joseph Krupp, Bangor, Pa.; Menashe Navi, Lebanon, N.J.; Thomas A. Ward, Whitehall, Pa.

[73] Assignee: Cutler-Hammer, Inc., Milwaukee, Wis.

[22] Filed: Nov. 1, 1974

[21] Appl. No.: 520,179

[52] U.S. Cl. ..... 270/55

[51] Int. Cl.[2] ..... B65H 5/30

[58] Field of Search ..... 270/55, 57, 58, 54, 270/60, 59, 78, 52, 56, 12; 271/91, 93, 102, 99, 11, 18.2, 273–276, 100

[56] References Cited

UNITED STATES PATENTS

| | | | |
|---|---|---|---|
| 1,774,580 | 9/1930 | Wich | 270/55 |
| 2,000,261 | 5/1935 | Spiess | 271/93 X |
| 2,262,798 | 11/1941 | Elliott | 271/29 |
| 2,461,573 | 2/1949 | Schweizer | 270/55 |
| 2,634,971 | 4/1953 | Schweizer | 270/55 |
| 2,704,209 | 3/1955 | Halahan | 271/99 |
| 2,796,255 | 6/1957 | Mitchell | 270/57 |
| 2,856,182 | 10/1958 | Cantrell | 270/57 |
| 3,202,421 | 8/1965 | Ganz | 271/274 |
| 3,210,074 | 10/1965 | Miaskoff | 271/274 X |
| 3,269,720 | 8/1966 | Schluckebier | 270/57 |
| 3,315,575 | 4/1967 | Pinto | 93/53 |
| 3,420,516 | 1/1969 | Guggisberg | 270/55 |
| 3,572,686 | 3/1971 | Day | 270/58 X |
| 3,621,976 | 11/1971 | Moore | 198/57 |
| 3,663,008 | 5/1972 | Peterson et al. | 270/55 |
| 3,692,300 | 9/1972 | Mebus | 270/55 |
| 3,711,083 | 1/1973 | Cantrell, Sr. | 270/55 |
| 3,809,384 | 5/1974 | Zugel | 270/54 |
| 3,874,649 | 4/1975 | Bryson et al. | 270/55 |
| 3,877,692 | 4/1975 | Kluge et al. | 270/55 |
| 3,881,716 | 5/1975 | Bryson et al. | 270/12 |
| 3,926,423 | 12/1975 | Merker et al. | 270/55 |

*Primary Examiner*—Robert W. Michell
*Assistant Examiner*—V. Millin
*Attorney, Agent, or Firm*—David H. Semmes

[57] ABSTRACT

Apparatus and method for high speed in-line paper inserting, primarily for insertion of supplements and the like into newspapers, wherein newspaper jackets and inserts are advanced and manipulated in a straight line motion. The system includes means for rectilinearly conveying a folded newspaper jacket and placement thereof in a pocket, where the jacket is opened by an edge gripping mechanism, and an insert is impelled into the so opened jacket at a higher speed than that of the advancing jacket, the jacket then being released by the gripping mechanism to close with the insert therein, and the assembled newspaper, including insert, is then removed from the jacket for further conveying and processing. The insert pick-up station being of an improved advanced design to so improve pick-up and advancement of the insert.

12 Claims, 23 Drawing Figures

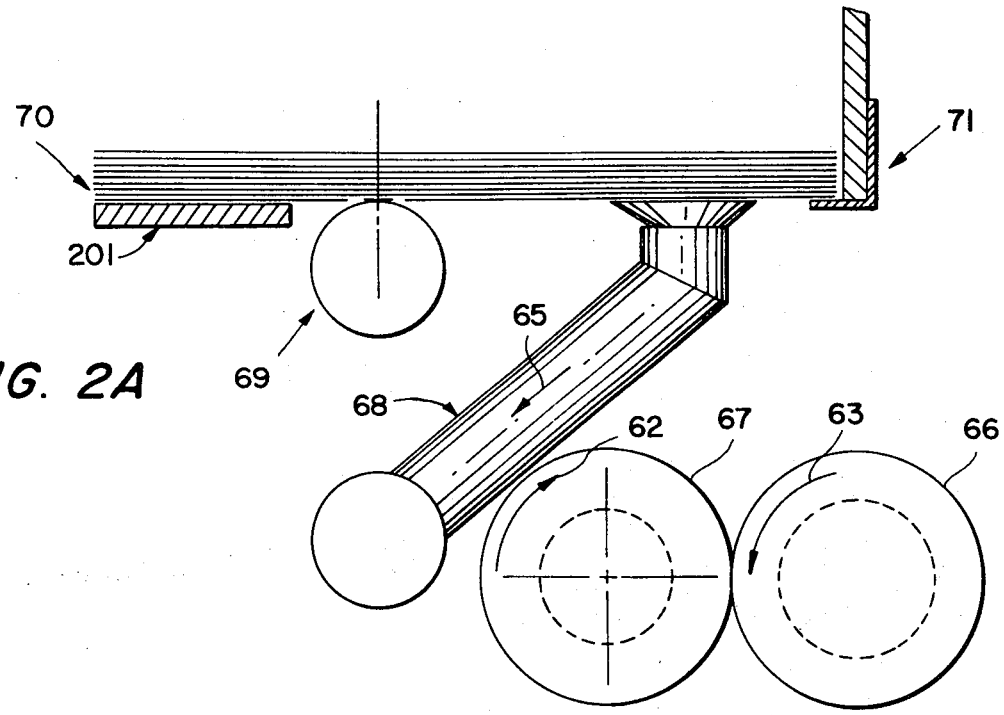
FIG. 2A
FIG. 2B
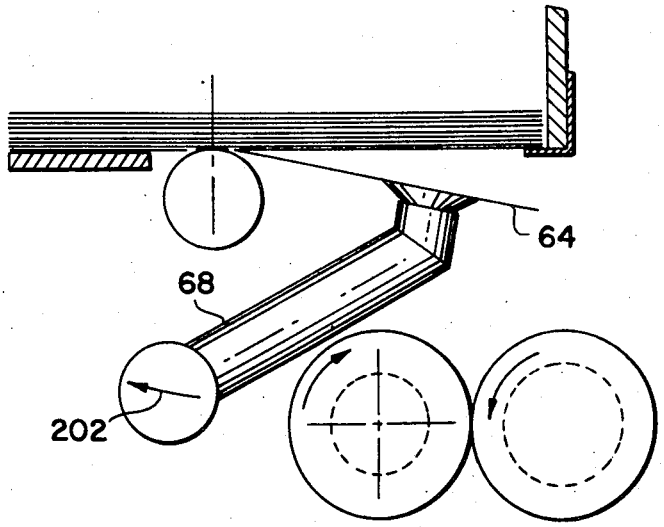

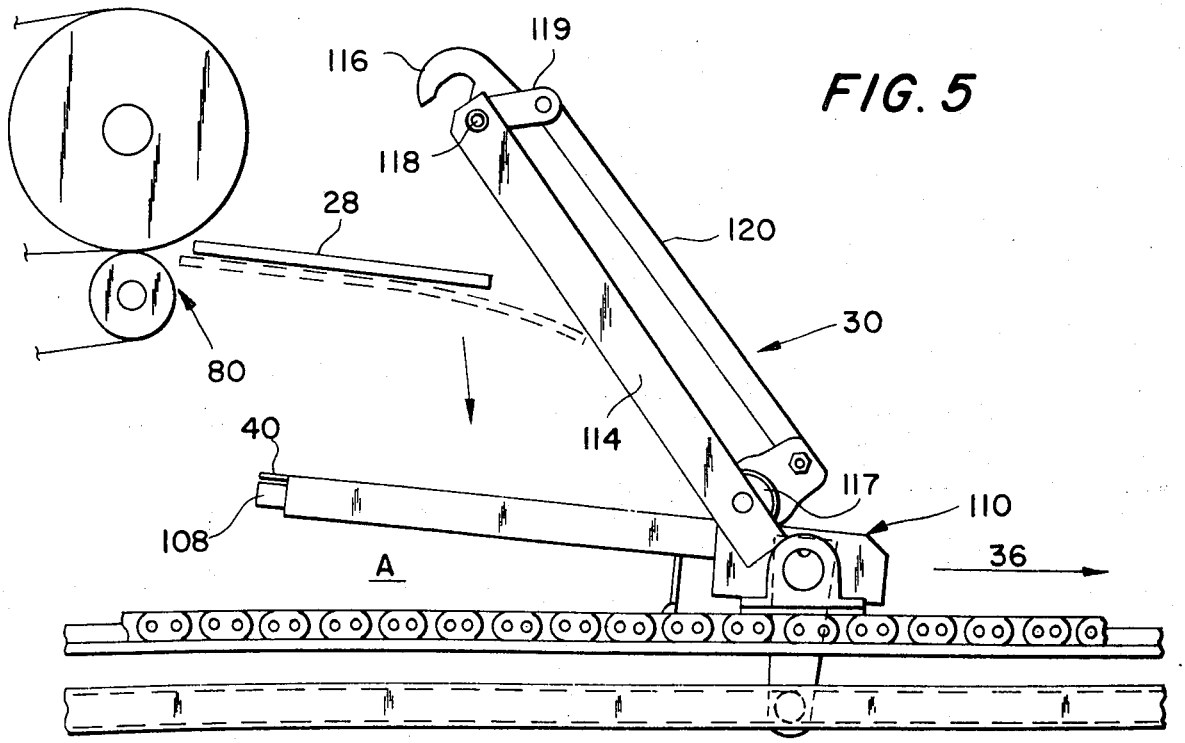
FIG. 5
FIG. 6
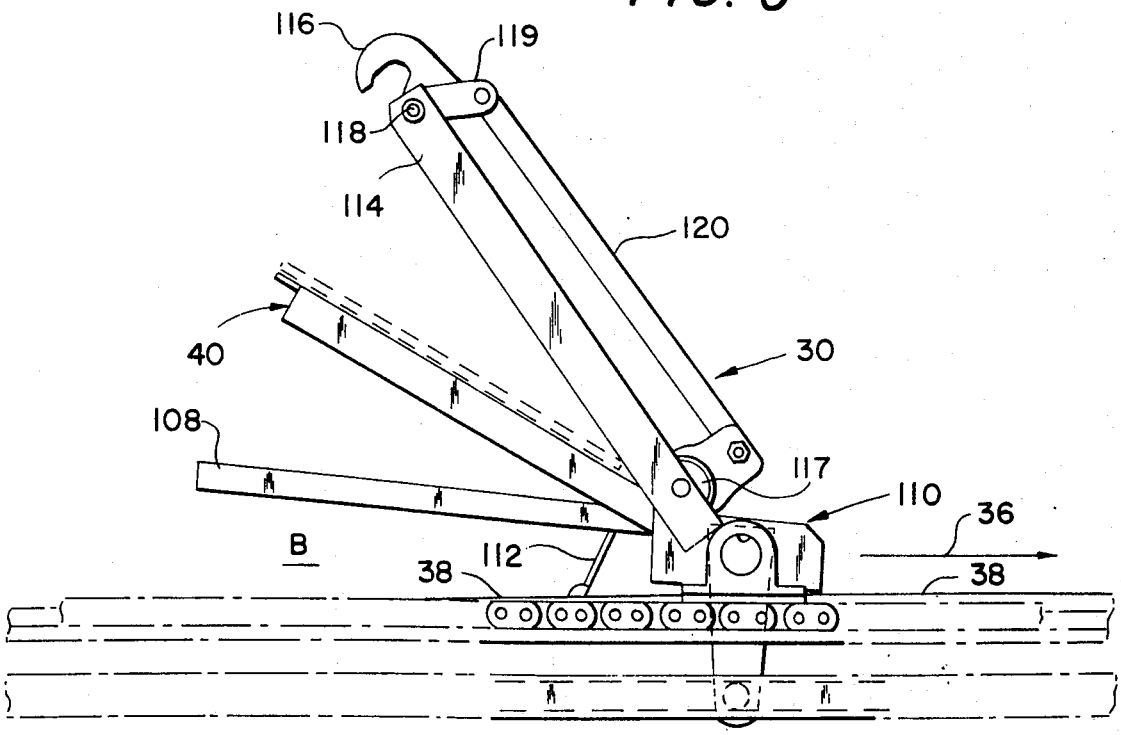

HIGH SPEED IN-LINE PAPER INSERTING APPARATUS AND METHOD

BACKGROUND OF THE INVENTION:

This application is of common assignment to U.S. Pat. No. 3,926,423 entitled High Speed In-Line Paper Inserting Apparatus And Method.

There has been a continuing and successful effort in the newspaper industry to increase press speeds of papers being printed and processed for distribution. Press speeds have increased substantially and there has resulted an increased need for method and apparatus which will commensurately permit increasing the speed of insertion of supplements and the like into newspapers.

The present invention provides method and apparatus which to a great degree solve this existing need for higher speed of insertion of supplements and the like into newspapers commensurate with the increased speed of the presses.

BRIEF DESCRIPTION OF THE INVENTION

The present invention is directed to a high speed in-line inserting machine adapted for operation and press speeds of modern machines in the region of 40,000 – 80,000 papers per hour. In order to accomplish this, it has been found necessary that the apparatus and method handle the jackets and the inserts in a straight line motion without changing direction as is the case with most presently known and used machines. This straight line motion permits a higher speed of operation.

In accomplishing the desired operation, the newspaper is folded in a folder so that it has a ⅝ inch lap on the top half and it is then moved along a conveyor that has the lead edges of the newspaper spaced, for example, 20 inches apart. The jacket runs into a speed-up mechanism which increases its speed by a factor of greater than three. The newspaper is ejected from the speed-up mechanism and, with the aid of guides, is shot or impelled into a pocket which is rectilinearly moving. The paper is lifted and, by means of grippers, the lap of the top half of the newspaper is so gripped and manipulated as to open the jacket into a condition ready to receive the insert. The insert is then impelled or shot into the jacket at a speed of approximately 4 to 1 greater than the speed of the pockets. After the supplement insert, the grippers release the top half of the newspaper which then falls to a closed position and the newspaper with the insert is then stripped out of the pockets and the completed product is then moved to a conveyor system which re-shingles them for a later folded edge stacker acceptance.

The inserts of the parent application are manipulated by means of a vacuum drum and belts to move them to an insert speed-up mechanism which accelerates the insert to the speed greater than the moving pockets.

The apparatus also includes speed and implement correlating means for varying operating conditions.

An object of the present invention is to improve the insert pickup station to function smoothly and efficiently with the complimentary high speed apparatus of this invention.

Additional objects, advantages and features of the invention will be more readily apparent from the following detailed description of an embodiment thereof when taken together with the accompanying drawings in which:

FIGS. 2A–2G are schematic views of the insert pick-up station;

FIG. 5 is a fragmentary side elevational view of a newspaper receiving pocket for a folded newspaper from the delivery mechanism subsequent to the press;

FIG. 6 is a view similar to FIG. 5 showing a subsequent step preliminarily to opening of the jacket;

Figure 1:
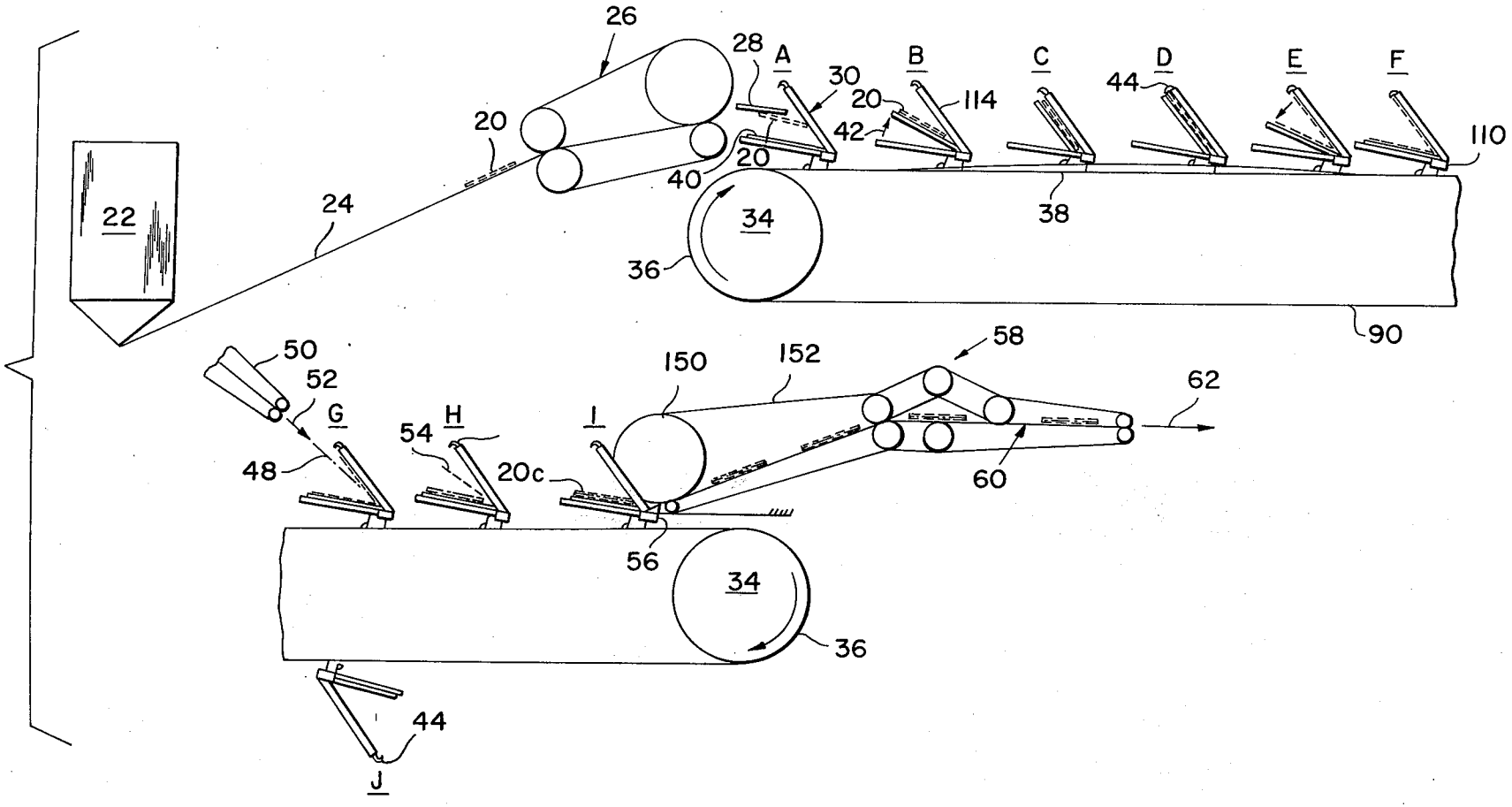
FIG. 1 is a schematic view of an overall system incorporating the present invention.

Referring now in greater detail to the drawings, there is shown in FIG. 1 a schematic of the overall apparatus wherein a newspaper, hereinafter referred to as a jacket, shown at 20 has been folded in folder 22 so that it has a ⅝ inch lap on the top half and is moved along a conveyor 24 with the lead edges of the jackets or newspapers spaced approximately 20 inches apart. The jacket runs into a speed-up mechanism 26 which increases its speed by a little more than a factor of three. The jacket is ejected from the speed-up mechanism, and with the aid of guides 28, shot into a pocket generally designated 30, a plurality of which are spaced along a chain drive system generally designated 32 which includes spaced chains, hereinafter described, entrained over main drive sprockets 34 driven as indicated by arrows 36 in such a manner that the pockets 30 are moved to the right on the upper run and after passing around the right hand sprocket 34 in the lower return run move from right to left.

The overall function will be described with reference to a plurality of stations A–J of the pockets 30. The jacket is shot or impelled into pocket 30 at station A. A cam 38 causes a paper lift arm 40 to raise the jacket partially as indicated by arrow 42 at station B and by station C the paper lift arm is held against the upper half of the pocket with the top and bottom half of the newspaper jacket positioned thereinbetween. These steps therefore ensure that the folded edge remains forwardly and downwardly as the folded jacket is rectilinearly conveyed while being pivoted forwardly between stations A – C. At station D, grippers generally designated 44 are activated and grip on the ⅝ inch lap on the top half of the newspaper jacket. At stations E and F the paper lift arm 40 gradually lowers the bottom half of the jacket, by simply backwardly pivoting only the bottom of the folded jacket there is defined a rearwardly and upwardly opening pocket which is rectilinearly conveyed past stations E and F with only the grippers 44 on the distal end of the fixed upper arm needed to maintain the pocket open. The jacket or newspaper is now ready for the insert. At station G the insert in the nature of a supplement 48 is shot or impelled into the jacket from insert delivery mechanism 50 as indicated by arrow 52 at a speed approximately 4 to 1 greater than the speed of the pockets. When the pocket reaches station H the grippers 44 release the top half of the jackets indicated at 54 and which at station I is contacted over and encompassing the insert. At station I the newspaper with the insert is stripped out of the pockets by a stripper mechanism generally designated 56. The completed product is then moved to a conveyor system 58 which serves to re-shingle the completed product as shown at 60 and thence are delivered as indicated by arrow 62 for further disposition such as a folded edge stacker acceptance.

U.S. patent application Ser. No. 427,763, now U.S. Pat. No. 3,926,423, discloses an insert lift platform which carries a stack of inserts to a vacuum drum pick-up. Although such an apparatus adequately performs its intended function of feeding inserts to the pockets, the feeding apparatus of the present invention more adequately performs this function in conjunction with the remaining structural components of the overall invention.

The new and improved insert feeding structure can best be seen schematically in FIG. 2A–2E. The inserts are placed in stack 70 and held in a substantially horizontal configuration by means of insert platform 201, insert stop lip 71 and roller 69.

Figure 3:
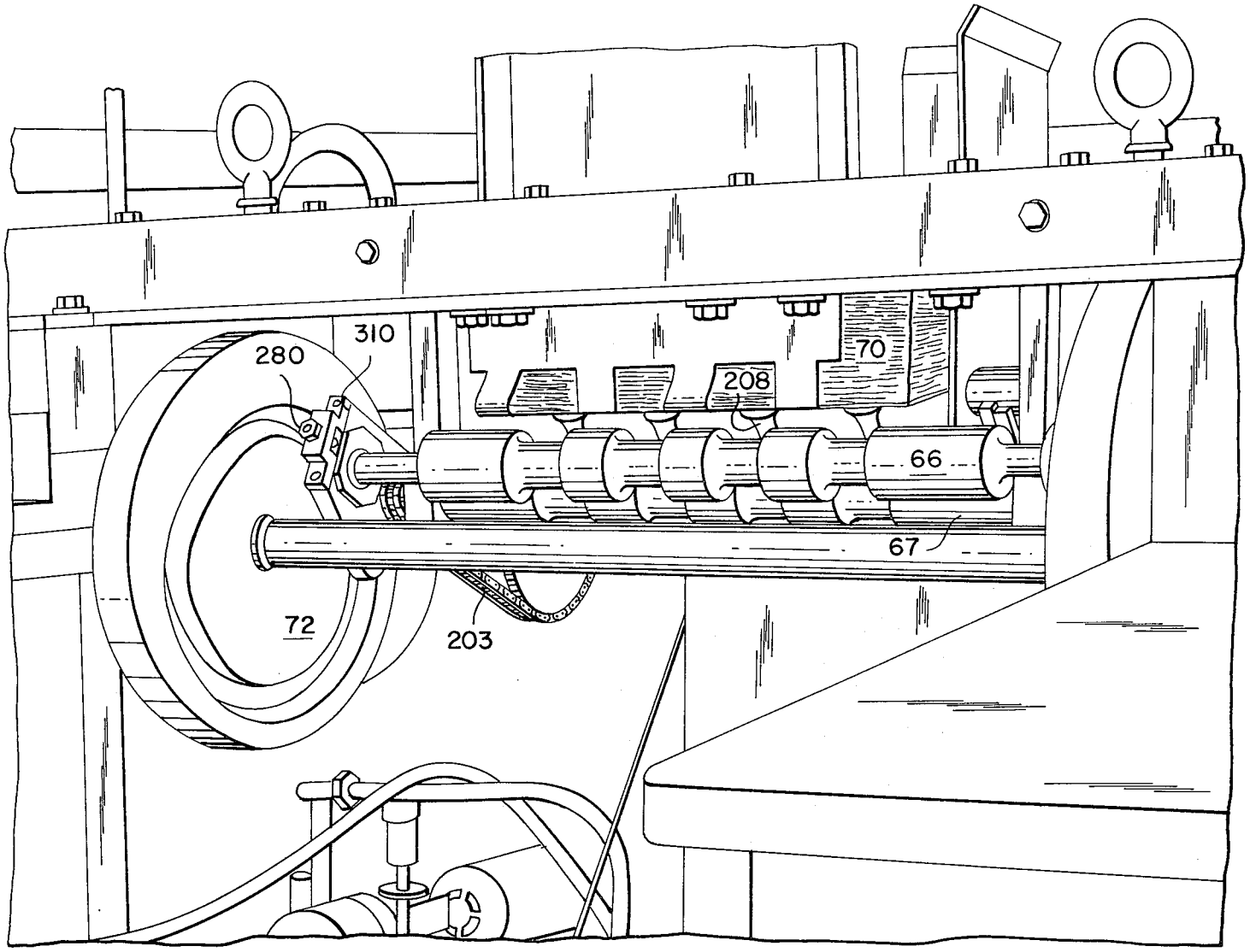
FIG. 3 is a fragmentary perspective view of an insert pick-up station.
Figure 4:
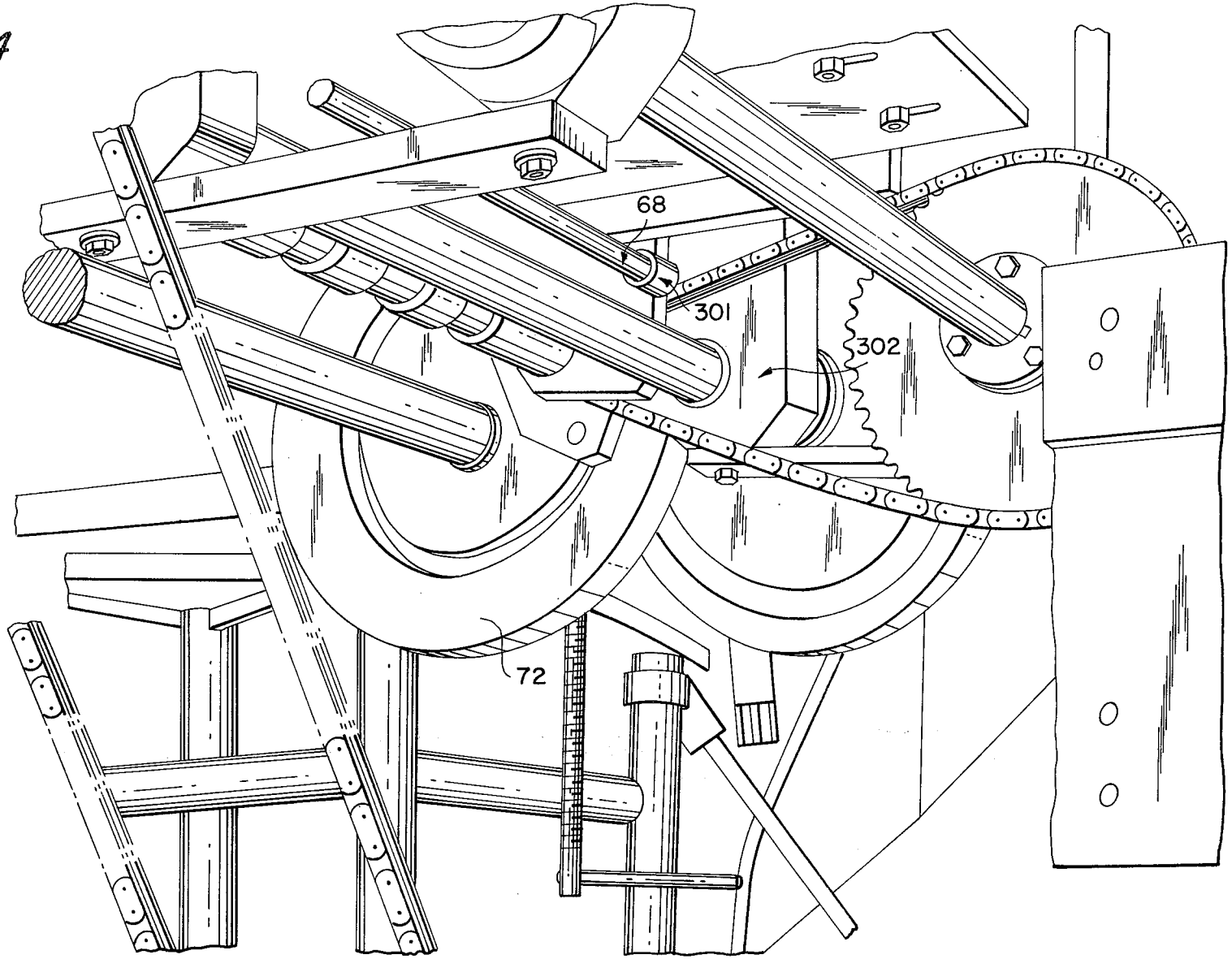
FIG. 4 is a fragmentary perspective bottom view of an insert pick-up station.
Figure 7:
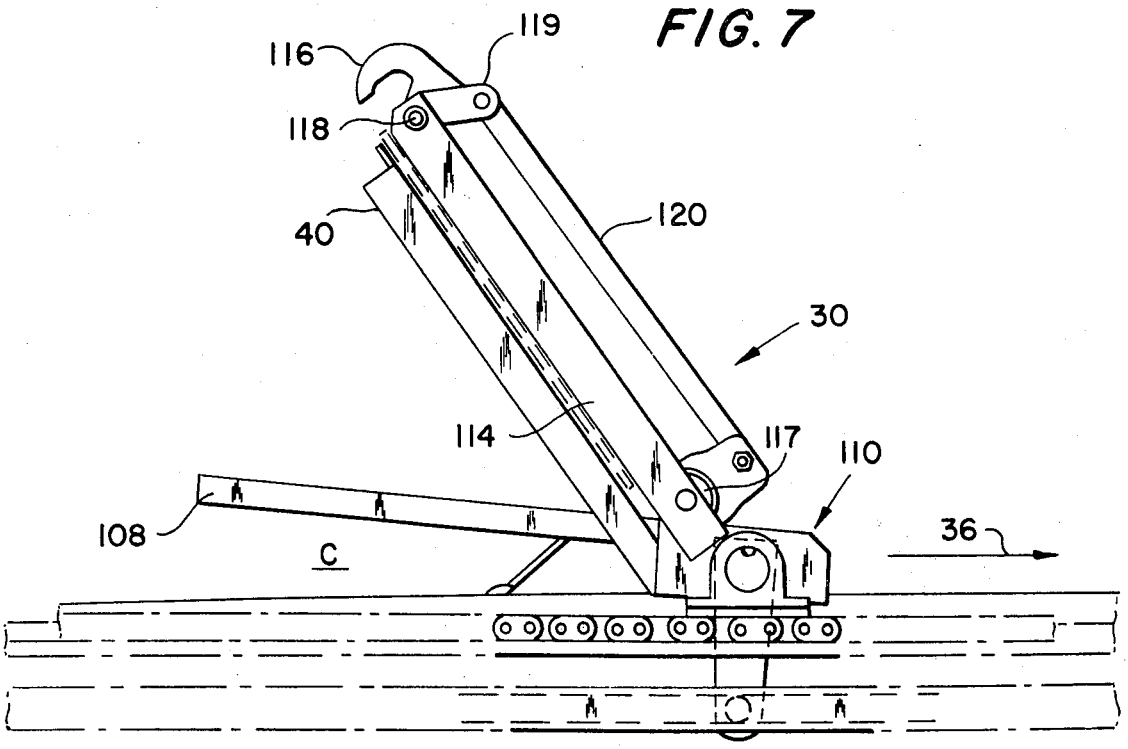
FIG. 7 is a view similar to FIG. 6 os a subsequent step in the jacket opening sequence.

At the proper time sequence in which an insert is to be fed to an open jacket, vacuum pump line 68 engages the lower most insert in stack 70 shown as element 64 by means of drawing a vacuum through the vacuum gripping members 208 (FIG. 3) which draws insert 64 from stack 70 (FIG. 2B). Vacuum line 68 is attached to block 302 by bearing 301 (FIG. 4). Thus, cam 72 acts to pivot vacuum line 68 downwardly so as to move insert 64 towards the upper and lower nipping rollers 66, 67. Cam means 72 further engages upper roller 66 through block 310 which is channeled within cam 72.

Figure 2C:
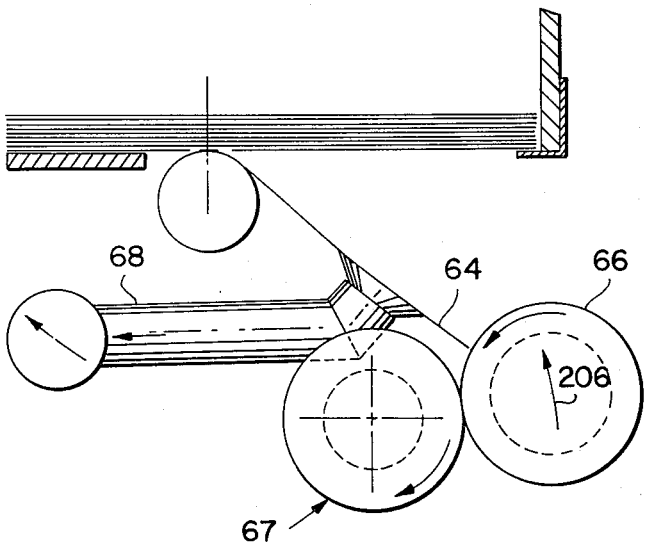
Figure 2D:
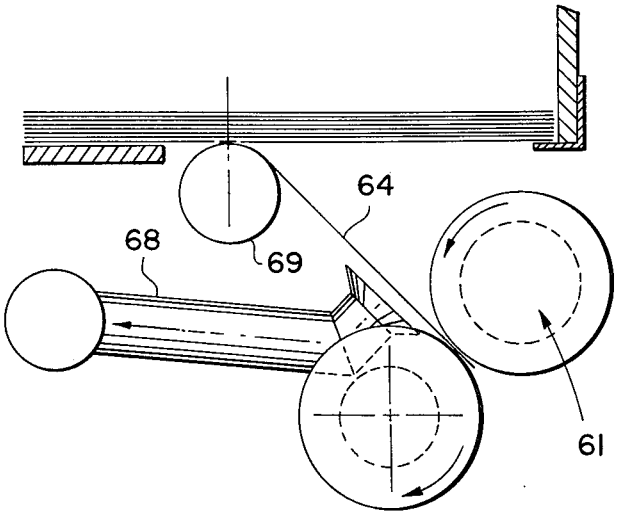
Figure 2F:
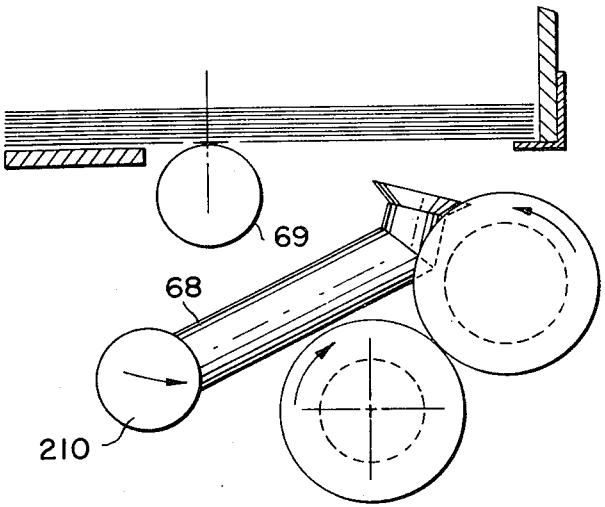
Figure 2E:
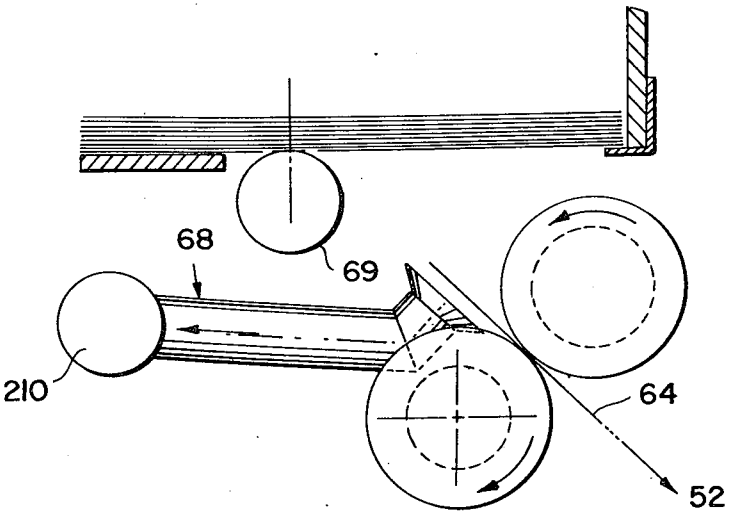

As insert 64 is lowered by vacuum gripping members 208, cam 72 simultaneously causes upper nipping roller 66 to move in the direction of arrow 206 (FIG. 2C). This allows for an extremely smooth engagement between insert 64 and upper and lower nipping rollers 66, 67 (see FIG. 2D). Simultaneously with the engagement of insert 64 with said nipping rollers, the vacuum being drawn through gripping members 208 and vacuum line 68 is automatically shut by means of an automatic shut-off bearing 301. Thus, insert 64 is free to be accelerated through upper and lower nipping rollers 66, 67 and projected in the direction of arrow 52 (FIG. 2E).

Figure 2G:
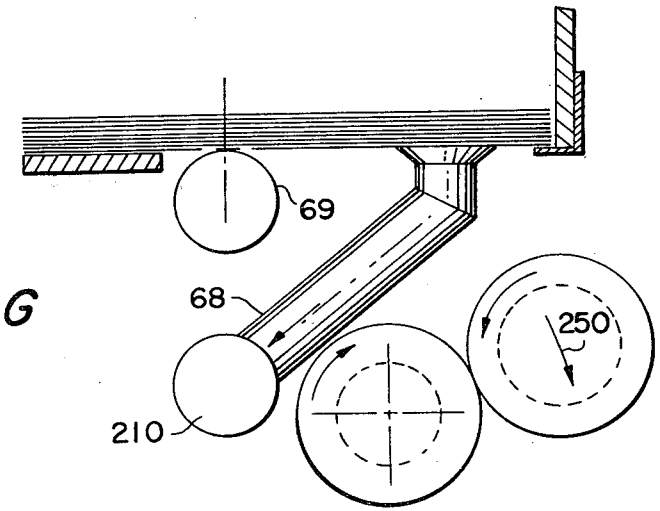

As cam 72 continues to rotate, block 301 and upper nipping roller 66 return to their original position with vacuum gripping members 208 contacting the next insert in stack 70 while the upper nipping roller 66 follows path 250 (FIG. 2G) until an original position is reached (FIG. 2A). By causing upper nipping roller 66 to travel according to arrows 206, 250, while simultaneously moving vacuum line 68 as shown to pivot about roller 69 in the direction 202, at FIG. 2B, extremely smooth engagement is assured between insert 64 and nipping rollers 66, 67.

By means of adjusting set screws 280 the distance between upper and lower nipping rollers 66, 67 can be adjusted so that the insert pick-up station of the present invention can accommodate inserts of varying thickness.

The insert pick-up station of the present invention is placed within the overall high speed in-line paper inserting apparatus in a manner equivalent to that shown in parent application U.S. Ser. No. 427,763. FIG. 2 of the parent application shows how the insert pick-up station is actuated and such teaching is incorporated herein by reference. As done in the parent application, the insert pick-up station functions so that inserts are removed by the vacuum gripping means, injected between the upper and lower nipping rollers and accelerated through said rollers in a timed relationship to correspond to the movement of the conveyor which conveys the folded newspapers to their respective opening stations.

Figure 8:
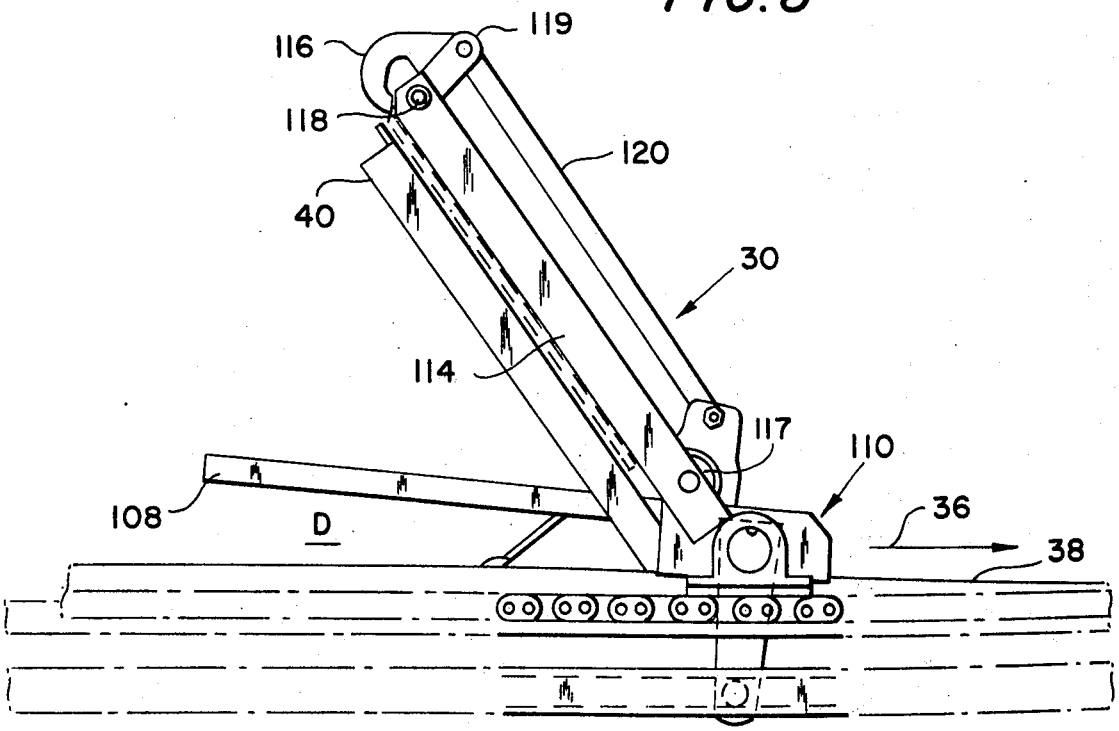
FIG. 8 is a view similar to FIG. 7 showing a subsequent step including gripping of an extended edge of the newspaper jacket.
Figure 9:
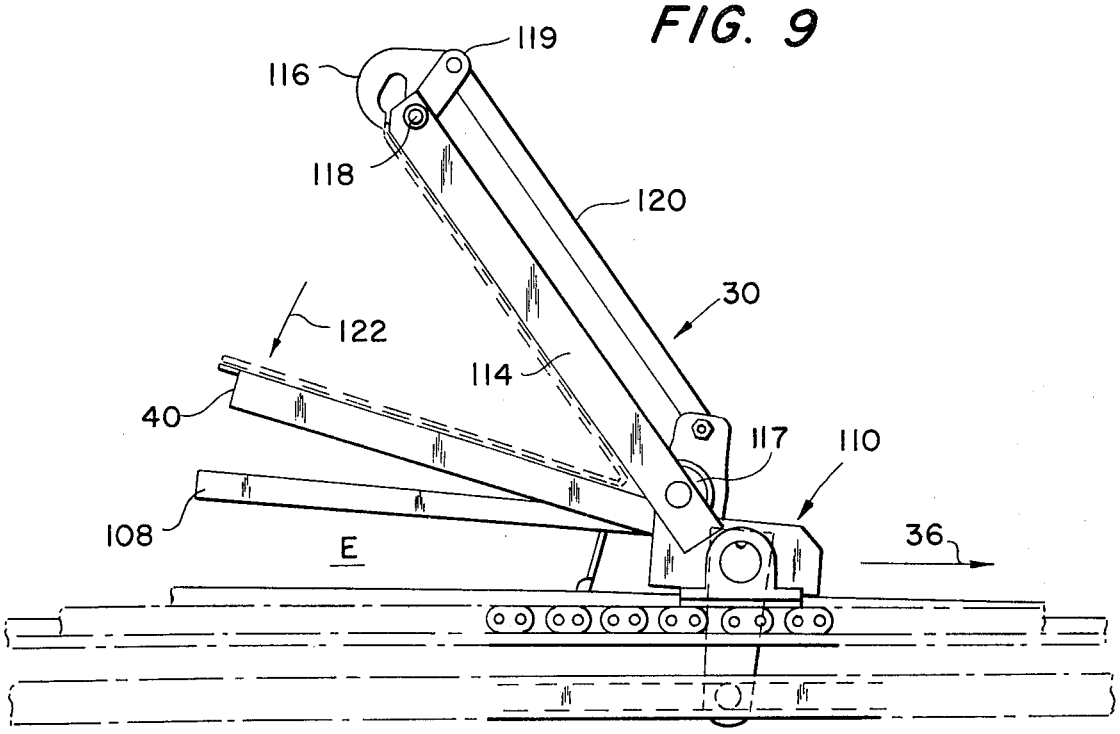
FIG. 9 is a view similar to FIG. 8 showing the next sequential step in which the jacket is partially opened.

The pockets 30 and related mechanism for opening of the jacket to permit the inserts to be placed therein will be more apparent from a study of FIGS. 5–13 inclusive which correspond respectively with stations A to I of FIG. 1. The pockets as previously mentioned are connected to chains 90 entrained around sprockets 34 and move with the chains in the direction shown in 36. Each of the pockets includes a base arm 108 which has a fixed relationship on mounting bracket 110 attached to shafts 111. The newspaper lift arm 40 is pivotally mounted to bracket 110 and has operatively attached thereto a cam follower arm 112 which operatively engages with the upper surface of cam 38 which, as seen in FIG. 6 has a beveled leading edge so that as the pockets translate along the apparatus, the arm 112 rides onto the cam which extends downwardly to station E along the run of the machine. Therefore, as the pockets 30 move, the arms 40 are raised by coaction of arm 112 and cam 38 as indicated by arrow 42 at station B, carrying the newspaper jacket 20 therewith to an operative engaging position at station D with an upper arm 114 which also has a fixed angular position by means of the bracket mounting at 110. When arriving at station D, the grippers 44 are actuated. These grippers include gripper hooks 116 pivotally mounted at 118 on arms 114 and are actuatable through pivot arm 119 attached to the hook and which in turn is pivotally moved through arm 120 as hereinafter described. At station D, the gripper hook 116 engages with and about the extended edge of the folded newspaper as hereinbefore described and secures this portion of the folded newspaper with respect to arm 114. This relationship is shown in FIG. 8 which corresponds with station D.

Figure 10:
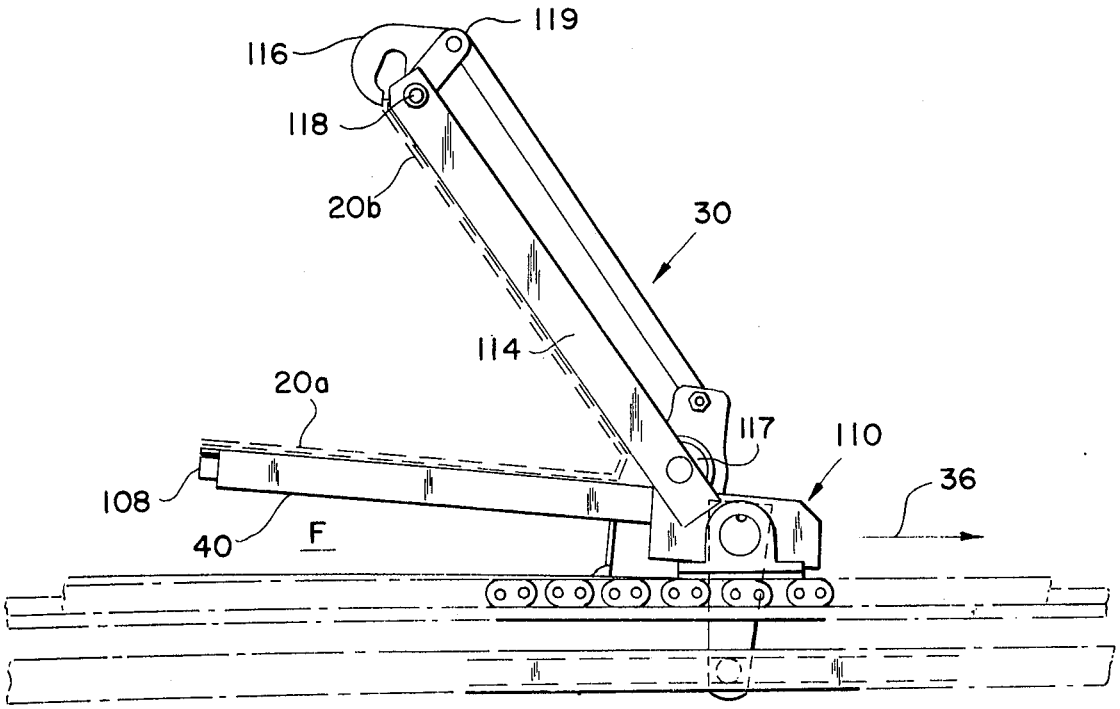
FIG. 10 is a view similar to FIG. 9 disclosing the jacket in fully opened position for reception of an insert therein.
Figure 11:
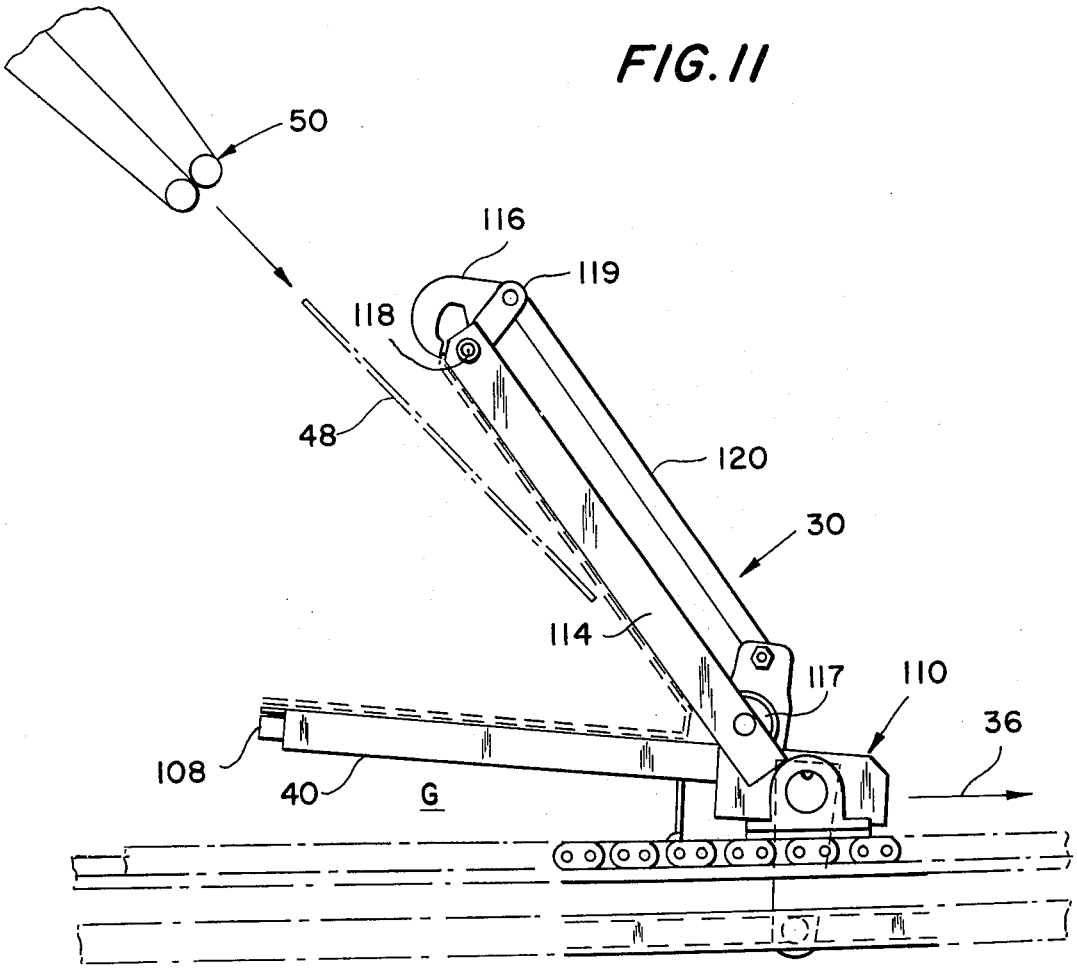
FIG. 11 is a side elevational view disclosing the jacket in opened position and the step of inserting a supplement thereinto.

Subsequent to station D, the cam 38 bevels off and permits arm 40 to descend as shown by arrow 122 in FIG. 8 to its original position as shown in FIG. 10 with the lower half of the folded newspaper resting thereon as shown at 20A in FIG. 10 and the gripped upper half of the newspaper shown at 20B so that the newspaper is in a fully opened position adapted to receive the insert 48 from insert mechanism 50 as shown in FIG. 11 corresponding to station G.

Figure 12:
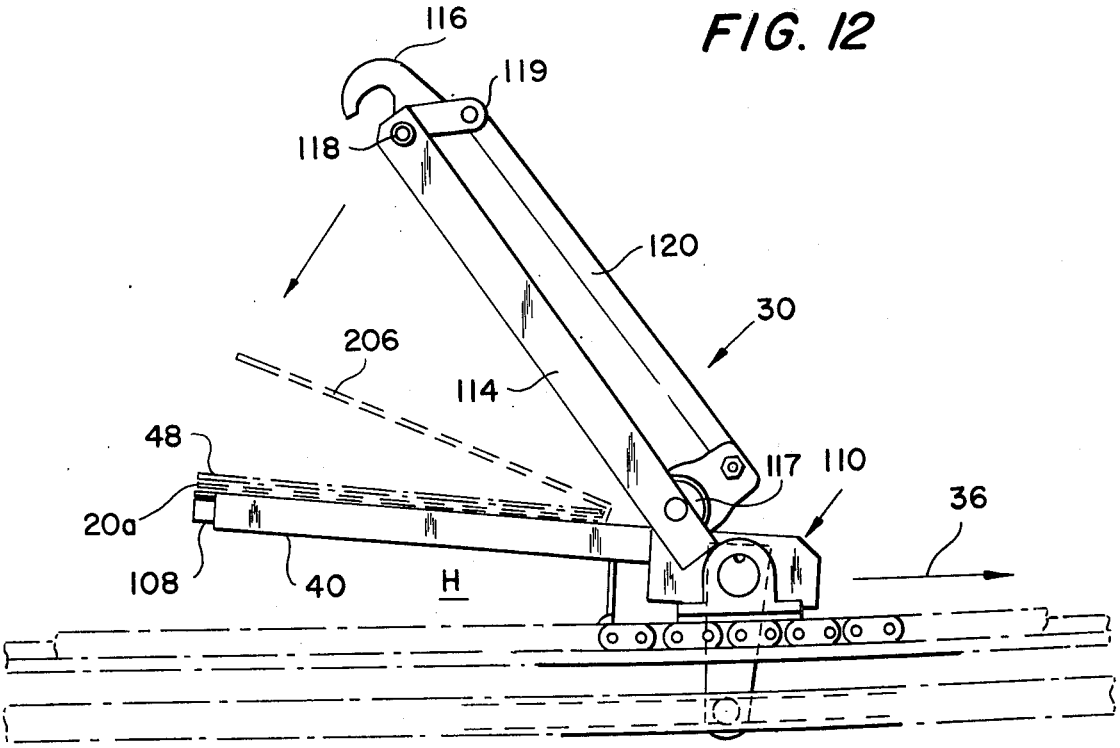
FIG. 12 is a view similar to FIG. 11 showing a subsequent step of release of the jacket following the insertion step for closing of the jacket.
Figure 13:
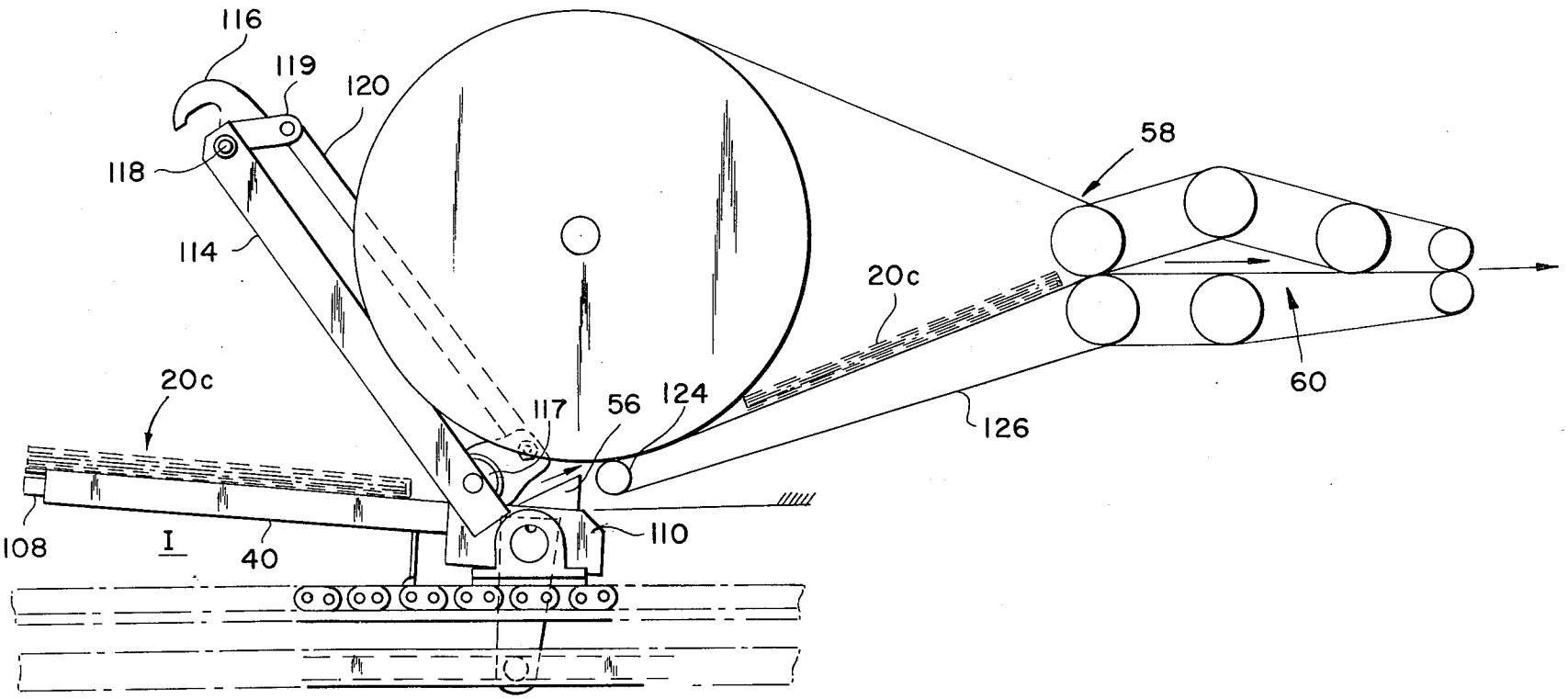
FIG. 13 is a fragmentary side elevational view of a newspaper including jacket and insert pick-up and delivery mechanism.

Subsequently, in the line of travel the gripper hook is released as shown in FIG. 12 corresponding with station H, permitting the upper half of the newspaper 20B to fall downwardly and, as shown in FIG. 13, the then assembled newspaper and insert combination 20C is ready for removal from the apparatus for further processing. This condition in FIG. 13 corresponds with station I of FIG. 1.

At this point, the stripper mechanism 56 engages under the composite newspaper and insert 20C which is conveyed upwardly by conveyor system 58 of the takeoff mechanism, which includes nipping rollers 124 and belt 126, and carried to the re-shingler at 60 for subsequent disposition as shown by arrow 62 in FIG. 1.

Figure 14:
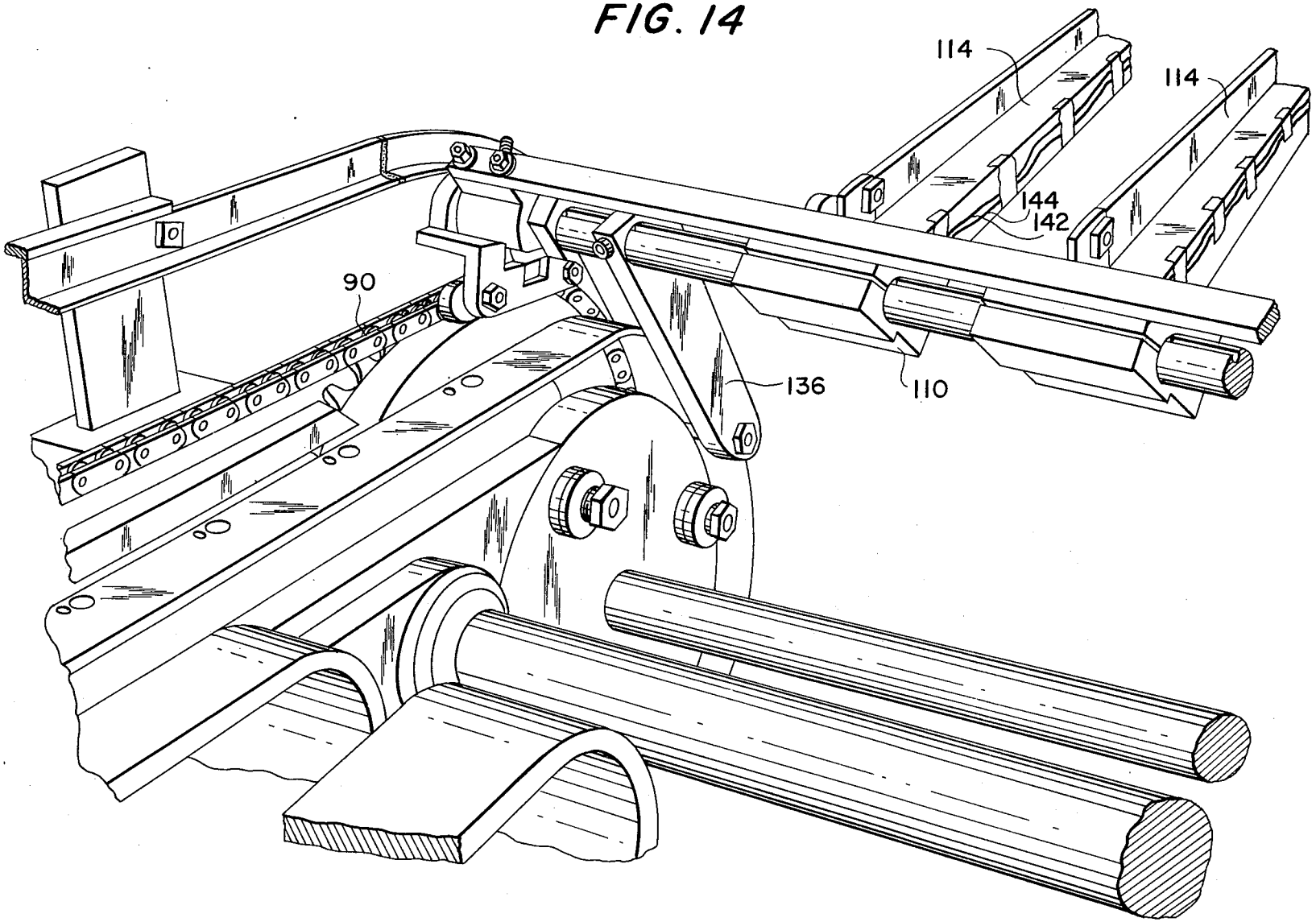
FIG. 14 is a fragmentary perspective view disclosing details of pick-up mechanism for opening the jacket and control mechanism therefor.
Figure 15:
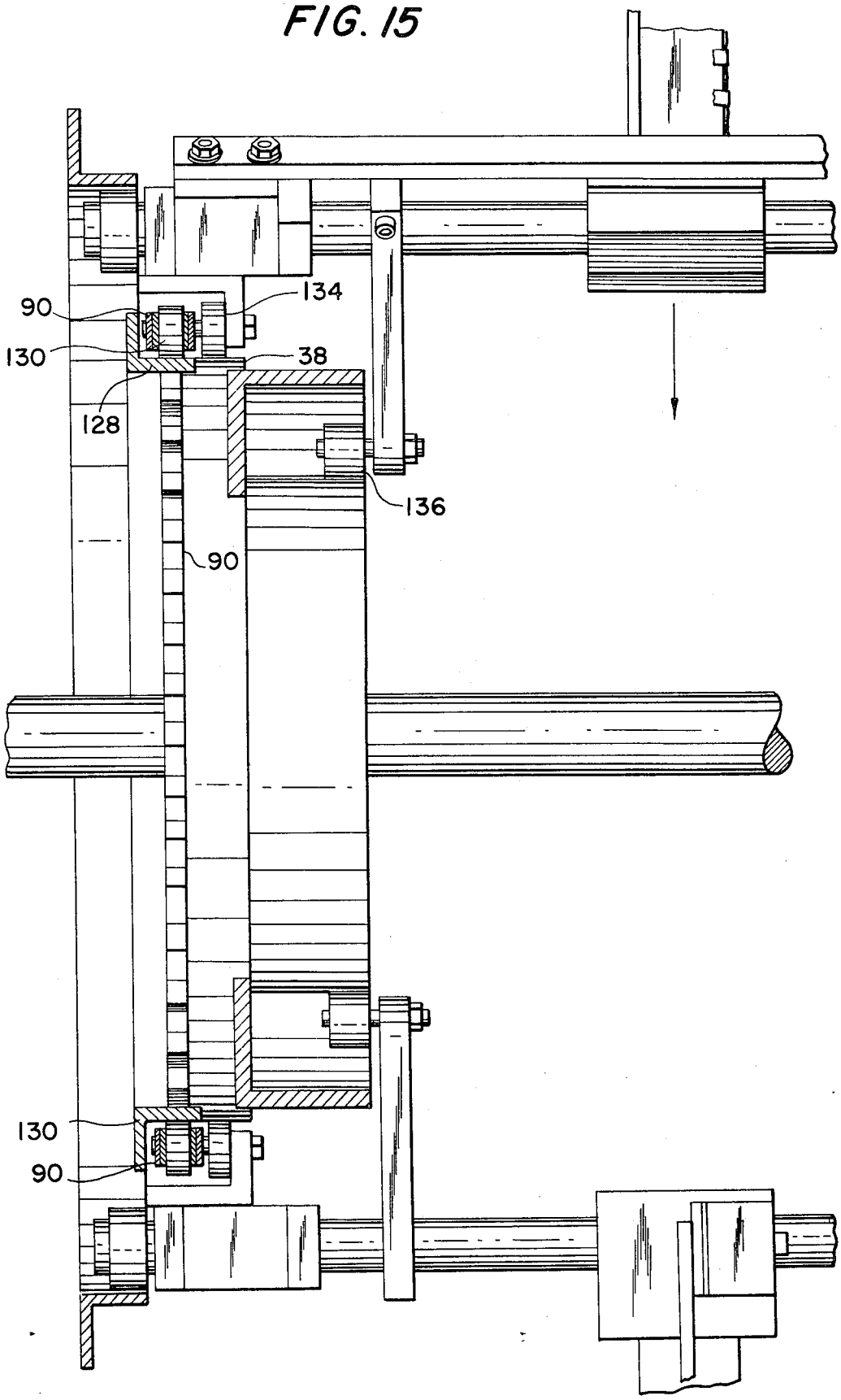
FIG. 15 is a fragmentary cross sectional view through one side of the apparatus disclosing control mechanism for the jacket opening mechanism.

As shown in FIGS. 14 and 15, the mounting and drive mechanism for the pockets 30 include upper and lower guides or guide channels 128 and 130 which are operatively engaged by rollers 130 which serve as a track for chains 90 and support brackets 110 mounting pockets 30. The path of travel of the chains and pockets is shown in FIG. 2 of the parent application. It will be seen that subsequent to station I, the pockets are carried around the aft sprocket 34 from the upper chain run to the lower chain run as shown at station J. The cam and cam follower mechanism are shown in FIGS. 14 and 15. The cam follower arm includes roller 134 which engages with the upper surface of cam 38. A cam follower mechanism generally designated 136 serves to maintain in place are shown in FIG. 14 whereas in the cross sectional view of FIG. 15 showing one side, the cam follower of FIG. 14 and the top arm are ready to come down to the lower run to return to the initial position at station A in the path of travel.

Figure 16:
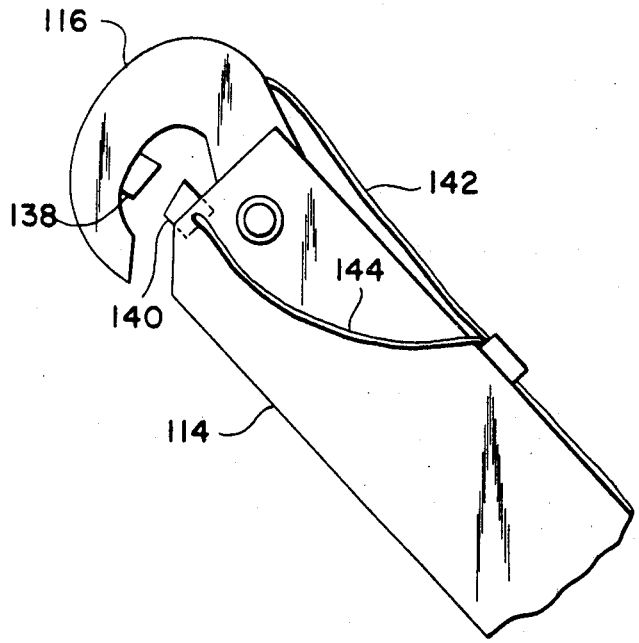
FIG. 16 is a fragmentary elevational view of jacket edge gripping mechanism.
Figure 17:
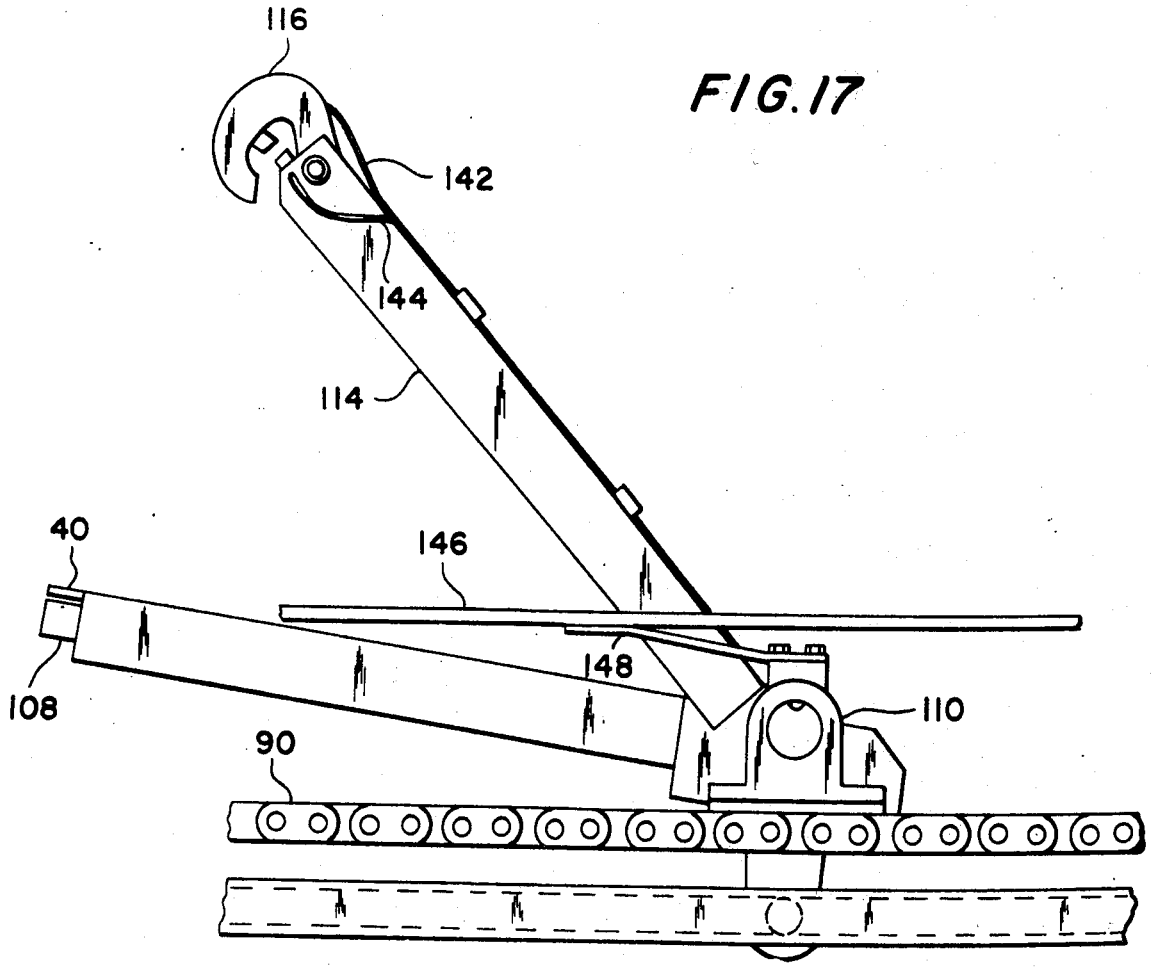
FIG. 17 is a fragmentary side elevational view of the jacket edge gripper mechanism of FIG. 15 and operating mechanism therefor.
Figure 18:
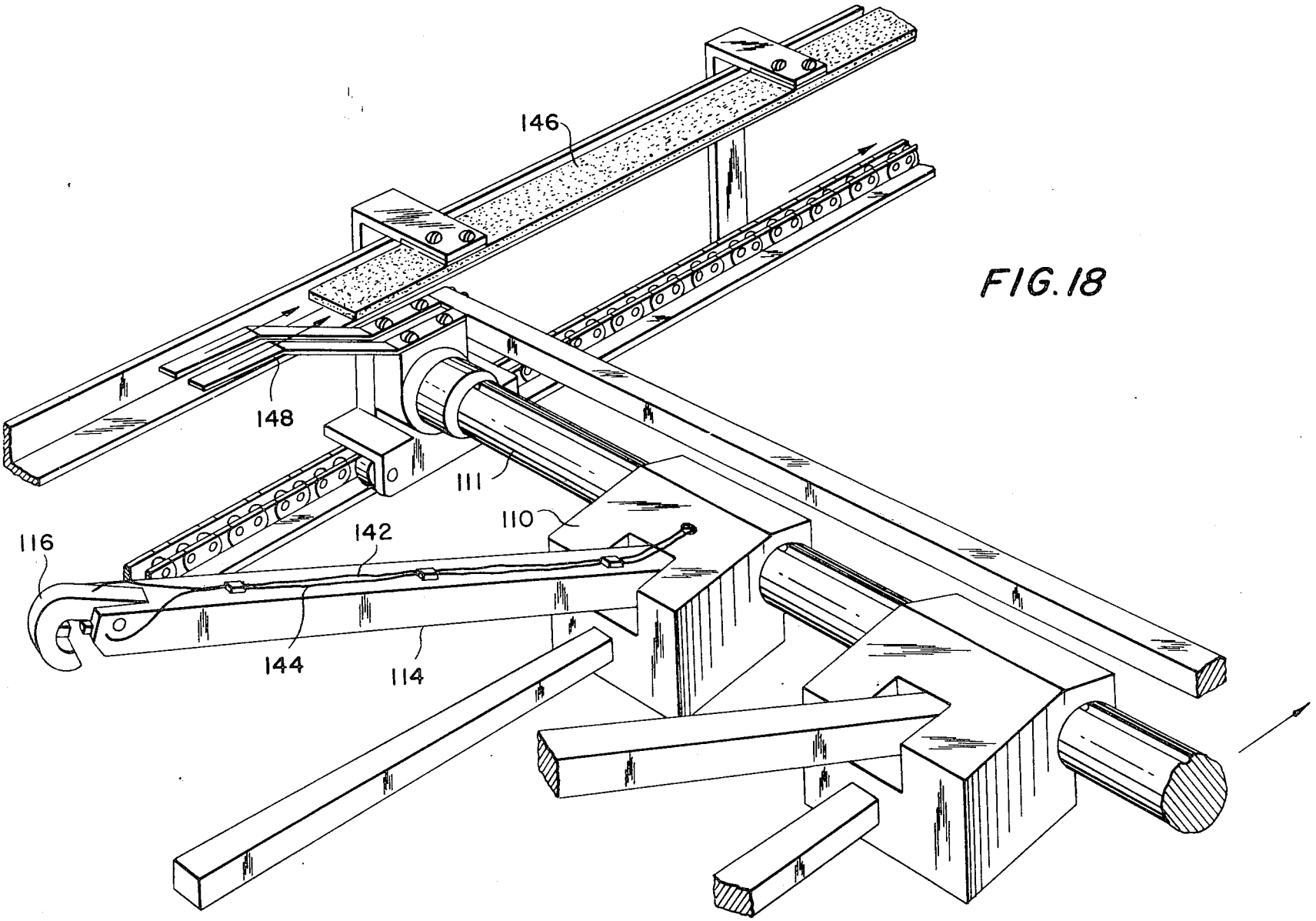
FIG. 18 is a fragmentary perspective view of the mechanism of FIG. 17 in association with the overall apparatus.

One form of operating mechanism for the gripper hooks is shown in FIGS. 16–18. The gripper hook 116 and fixed arm 114 respectively mount magnetic heads 138 and 140, which are wired as shown at 142 and 144 respectively to a conductor strip 146 appropriately electrically connected and spring finger arms 148, adapted for engagement in sliding contact with conductor strip 146. Conductor strip 146 is mounted beneath the track and extends from station D through station G, thereafter terminating prior to station H. The finger arms 148 during their period of contact with conductor strip 146 actuate the gripper hooks 116 to a closed position and thereafter the hooks are released as shown at station H to release the top portion of the paper. While magnetically actuated means have here been shown for operating the gripper hooks, manifestly other types of actuating mechanism can be used such as shown, for example, in FIGS. 5–13.

In FIGS. 5–13 the actuating mechanism for the gripper hooks includes an electrically operated rotary solenoid 117 mounted at the base of arm 114. Upon actuation, solenoid 117 moves arm 120, and through pivot arm 119, pivots gripper hook 116 to open and closed positions.

It is to be noted that a plurality of arms are laterally spaced across the run of the chains with a plurality of gripping hooks as shown in FIG. 2 of the parent application. This insures adequate gripping of the edge of the newspaper for opening to implement insertion of the insert or supplement in the so opened jacket. At the takeoff position, a plurality of pulleys 150 are interleaved between the arms and mount a plurality of belts 152 for removal of the composite newspaper and insert as previously described.

The construction and operation of the apparatus will be apparent from the foregoing detailed description. Manifestly, however, changes in details of construction can be effected without departing from the spirit and scope of the invention as defined in and limited solely by the appended claims.

We claim:

1. In a method of high speed in-line inserting of a supplement insert into a newspaper comprising the steps of:

A. folding a newspaper to provide an extending lap on the top half of said folded newspaper with respect to the bottom half, conveying said folded newspaper as a folded jacket with the folded edge forwardly disposed to a speed up station, and B. accelerating said folded jacket forwardly and downwardly for a rectilinear series of steps wherein said folded edge is rectilinearly conveyed forwardly and downwardly with respect to said extended lap, said rectilinear conveying steps further comprising in sequence:

i. forwardly pivoting said folded jacket relative to said folded edge while rectilinearly conveying and, ii. maintaining the top half of said jacket in said pivoted position, while rectilinearly conveying and, iii. backwardly pivoting only said bottom half of said jacket to thereby define a rearwardly and upwardly opening pocket which is rectilinearly conveyed, and C. impelling an insert forwardly and downwardly into said rearwardly opening pocket, said insert impelling speed being substantially greater than the rectilinearly conveying speed of said jacket to thereby seat said insert into said pocket, and;

D. backwardly pivoting said top half of said jacket onto said bottom half and rectilinearly conveying a folded composite of said jacket and said supplement insert;

E. the improvement comprising supplying said inserts to said impelling step by, i. engaging an insert with a vacuum gripping member;

ii. swinging said vacuum gripping member and attached insert toward a pivotable upper and a stationary lower nipping roller(s), said rollers being horizontally disposed;

iii. causing said upper nipping roller to rise and engage said insert; and iv. releasing said vacuum gripping member while simultaneously passing said insert from the upper nipping roller through the upper and lower nipping rollers wherein upon passing said insert through the upper and lower nipping rollers, the vacuum gripping member is raised to its starting position, against the next insert, while the upper nipping roller is lowered adjacent said lower nipping roller.

2. A method as claimed in claim 1, wherein subsequent to impelling said insert into said pocket, the gripped lap is released thereby permitting gravitational lowering of the top half of said newspaper onto said insert to form said composite jacket and supplement insert.

3. A method as claimed in claim 1, wherein said step of impelling said insert downwardly and forwardly is at a speed of approximately four times greater than the rectilinear speed of said jacket to facilitate the insert seating.

4. A method as claimed in claim 1, wherein said impelling step further comprises the steps of positioning said inserts as a stack being fed to the vacuum gripping member by gravity the insert being folded with the folded edge forwardly disposed, said vacuum gripping member engaging the bottom-most insert for subsequent feeding to the upper and lower nipping rollers.

5. A method as claimed in claim 1, wherein the spacing between said upper and lower nipping rollers is adjustable.

6. In an apparatus for high speed in-line inserting a supplement insert into a newspaper comprising, in sequence:

A. a newspaper folding mechanism including means to provide a folded newspaper having an extending lap on the top half with respect to the bottom half and to convey said folded newspaper as folded jacket with the folded edge forwardly disposed to a speed-up mechanism, B. said speed-up mechanism including means to accelerate said conveyed jacket forwardly and downwardly onto a rectilinearly moving conveyor, C. said rectilinearly moving conveyor comprising an endless conveyor, a plurality of folded newspaper jacket receiving means operatively connected to said conveyor in linearly spaced successive positions thereon, wherein each of said jacket receiving means comprises:

i. an angularly movable lower arm adapted to support and rectilinearly carry said jacket with its folded edge maintained forwardly and downwardly with respect to said extending lap, and ii. a fixed upper arm angularly disposed from said movable arm, said fixed upper arm together with said movable lower arm positioned to define a rearwardly and upwardly openable pocket which is rectilinearly conveyed upon said conveyor, and iii. newspaper top half edge gripping means mounted upon the distal end of said fixed upper arm to selectively maintain only said top half of the newspaper jacket against said fixed upper arm, and iv. means disposed along the rectilinear path of travel of said each newspaper jacket receiving means to coact with said movable lower arm to selectively pivot the newspaper jacket thereon supported forwardly into contact with said fixed upper arm whereby said gripping means are operable to selectively grip said extending lap while allowing said bottom half to be selectively rearwardly pivoted by said lower movable arm, thereby defining a rearwardly and upwardly opening pocket in said jacket which is rectilinearly conveyed, and;

D. means for impelling an insert downwardly and forwardly into said jacket pocket as it is rectilinearly conveyed therepast, wherein said insert is impelled downwardly and forwardly at a speed substantially greater than the rectilinear speed of said conveyor, and;

E. means for releasing said gripping means from said lap thereby closing said jacket with the insert therein as a folded composite;

F. the improvement to said means for impelling an insert comprising:

i. vacuum gripping means for engaging and gripping said insert;

ii. cam means for substantially simultaneously lowering said vacuum gripping means and attached insert, and pivotably raising an upper nipping roller into contact with said insert;

iii. means for substantially simultaneously releasing said vacuum gripping means from the insert while passing said insert between said raised upper nipping roller and a stationary lower nipping roller, whereupon said cam means further includes means for raising said vacuum gripping member to its starting position, against the next insert, while simultaneously lowering said upper nipping roller to a horizontal position adjacent said lower nipping roller.

7. Apparatus as claimed in claim 6, wherein the gripping means comprise pivotally mounted gripping hooks on the ends of said upper fixed arms of said pockets, and means for rotating said hooks in timed sequence with movement of said pockets on said conveyor when said lower arms have contacted said newspaper with said upper arms to thereby grip the overlapped edge of said newspaper and subsequently, after insertion of said supplement insert, to release said hooks to permit the upper half of the newspaper to gravitationally lower onto the lower newspaper half and insert to form said composite.

8. Apparatus as claimed in claim 6 wherein said inserts are in a stack which are fed to said vacuum gripping means by gravity, wherein said vacuum gripping means engages the bottom-most insert and removes said insert from the stack for feeding to said upper and lower nipping rollers, folded edge first.

9. Apparatus as claimed in claim 8 wherein said upper and lower nipping rollers are adjustable to accommodate inserts of differing thickness and wherein said upper and lower nipping rollers rotate to act as a speed up mechanism for subsequent ejection therefrom and insertion into said rearwardly open pockets in said newspapers.

10. Apparatus as claimed in claim 6 wherein said vacuum gripping means feeds said inserts to said upper and lower nipping rollers sequentially in timed relationship to movement of said conveyor and said pockets thereon.

11. Apparatus as claimed in claim 10, said conveyor mounting said pockets including endless chains operationally entrained over drive sprockets at the entrance and discharge ends of the conveyor, laterally extending shafts operatively connected between said spaced chains, brackets mounting said arms comprising said pockets with a plurality of sets of said arms being laterally spacedly mounted on said shafts to form laterally extending pockets, said arms being movable together with said chains on an upper run from the entrance end to the discharge end, around the rear sprocket and along the lower conveyor run, thence around the entrance end in a continuous cycle.

12. Apparatus as claimed in claim 11, including composite newspaper and insert stripping means at the rear end of said conveyor, said stripper means including a primary segmental pointed nose probe positioned in the line of travel of the newspaper composite spaced intermediately of said laterally spaced arms forming said pockets and engageable under the leading edge of newspaper composites being conveyed, and conveyor means including a plurality of belts entrained over pulleys and laterally spaced and positioned between said laterally spaced arms forming said pockets to receive newspaper composites stripped from said pockets for conveying and re-shingling the newspaper composites for presentation to a later folded edge stacker acceptance.

* * * * *